United States Patent [19]

Johnson

[11] 4,084,619

[45] Apr. 18, 1978

[54] ACTUATOR FOR HYDRAULIC SYSTEMS IN TRANSPORTABLE MOBILE PLATFORMS

[75] Inventor: Leonard L. Johnson, Ft. Wayne, Ind.

[73] Assignee: Teco, Inc., Ft. Wayne, Ind.

[21] Appl. No.: 746,661

[22] Filed: Dec. 2, 1976

[51] Int. Cl.[2] ..... E04G 1/22

[52] U.S. Cl. ..... 137/636.2; 74/471 XY; 91/413; 137/636.3; 180/66 R; 182/2; 214/1 CM

[58] Field of Search ..... 214/1 CM, 152, 674; 91/413; 137/636.2, 636.3; 182/2; 180/66 R; 74/471 XY

[56] References Cited

U.S. PATENT DOCUMENTS 2,836,467 5/1958 Myers ..... 182/2

FOREIGN PATENT DOCUMENTS 865,549 4/1961 United Kingdom ..... 182/2

*Primary Examiner*—Drayton E. Hoffman
*Assistant Examiner*—George F. Abraham

[57] ABSTRACT

In a self-transportable aerial platform, an operator employs a handle for controlling the vertical, horizontal and lateral movements of the platform in order to place the basket or platform at a preferred location. The operator-controlled handle operates a linkage which actuates one valve of a control to produce a first mode of platform movement; the handle is movable in a second direction to displace separately and distinctly a second valve for a further mode of operation; and the handle can further be twisted or turned to effect a separate and distinct movement of a third valve for the final mode of platform movement. The linkage consists of parallelogram linkage having the capability that one of said links can serve as a pivot for the other link, both of said links can be pivoted in unison as part of a parallelogram linkage, and both links of the parallelogram linkage can serve as journals for twisting movement of the handle which effects the additional mode of platform movement.

Each of the described handle movements separately, independently and distinctly operate an associated valve so that movement of the platform can be isolated to vertical, horizontal, or lateral movements or a combination of handle movements will effect concurrent and composite movements of the platform in the direction determined by the handle operation.

6 Claims, 9 Drawing Figures

ACTUATOR FOR HYDRAULIC SYSTEMS IN TRANSPORTABLE MOBILE PLATFORMS

BACKGROUND OF THE INVENTION

It is well accepted practice to use self-propelled vehicles with articulated booms having a movable platform or basket at the end of the articulated boom and power means for raising, lowering and controllably moving the platform in lateral and horizontal movements. The difficulty is most cases is how to control accurately and without excessive abruptness, the movements of the basket so the operator can easily and conveniently locate the basket precisely and with a degree of speed.

There are, of course, available controls for the power means which accomplish the boom movements but the shortcoming of such controls is that they tend to be lacking in sensitivity and accuracy. Moreover, the controls tend to produce basket movement with a jerkiness when smooth and gradual starting, stopping movements are needed for proper basket placement. This becomes an important consideration since the operator is called upon frequently to make repairs and installation of high voltage lines, for example, and it becomes important to the safety of the basket occupant that the basket be located in a smooth, accurate and efficient manner. These considerations are all essential to take into account and to satisfy, if maximum reliability and utility are to be realized from the self-propelled vertically and horizontally and laterally movable platforms.

It is further important that, should the basket be immobilized for any reason or another because of inability of the operator to function, that the controls at the upper basket level be disabled and that additional controls be available at ground level for lowering the movable platform or basket, such additional controls being independently operatable and fully capable of functioning separate and apart from the controls located in the basket.

OBJECTS OF THE INVENTION

It is an object of the present invention to provide a control system for a vertically emplaceable platform mounted on self-propelled vehicles so that the platform, which is associated with an articulated boom, can be transported by a truck or other vehicle to the desired spot and a control system disposed in the basket is then employed for locating the platform by a combination of desired vertical, horizontal and lateral movements into a desired position.

Another object of the present invention is to provide a new and improved control system in which, using a single control handle, the handle can be moved in three distinct modes to actuate independently an associated valve, each of such valves in turn being independently operable to effect a given mode of platform movement which is either horizontal, vertical or lateral.

Another object of the invention is to provide a control means in which a composite movement of the control handle can be employed to effect simultaneous movement of the platform to a desired position by concurrent horizontal, vertical and lateral movements.

It is an overall object of the present invention to provide a control system for a hydraulic system of the type disclosed in my co-pending Application Ser. No. 720,569, filed Sept. 7, 1976, titled, "IMPROVED FLUID CONTROL SYSTEM", and characterized by a combination of speed and feathered hydraulic actuation whereby the platform can be quickly brought to its approximate position and then "feathered" into final position with minimum abruptness and shaking of the basket as it approaches its final position.

Other objects and features of the present invention will become apparent from consideration of the following description which proceeds with reference to the accompanying drawings.

DRAWINGS

Figure 9:
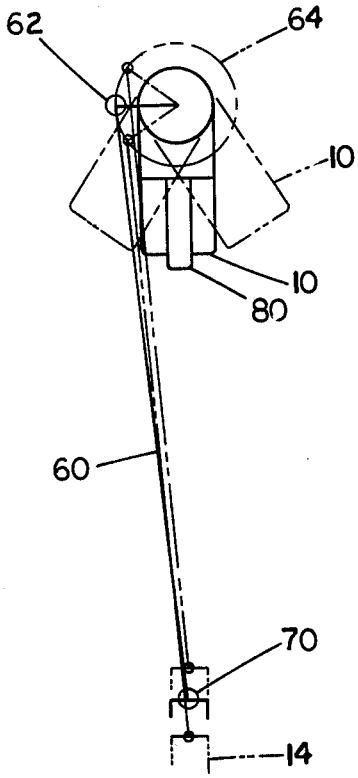
Figure 6:
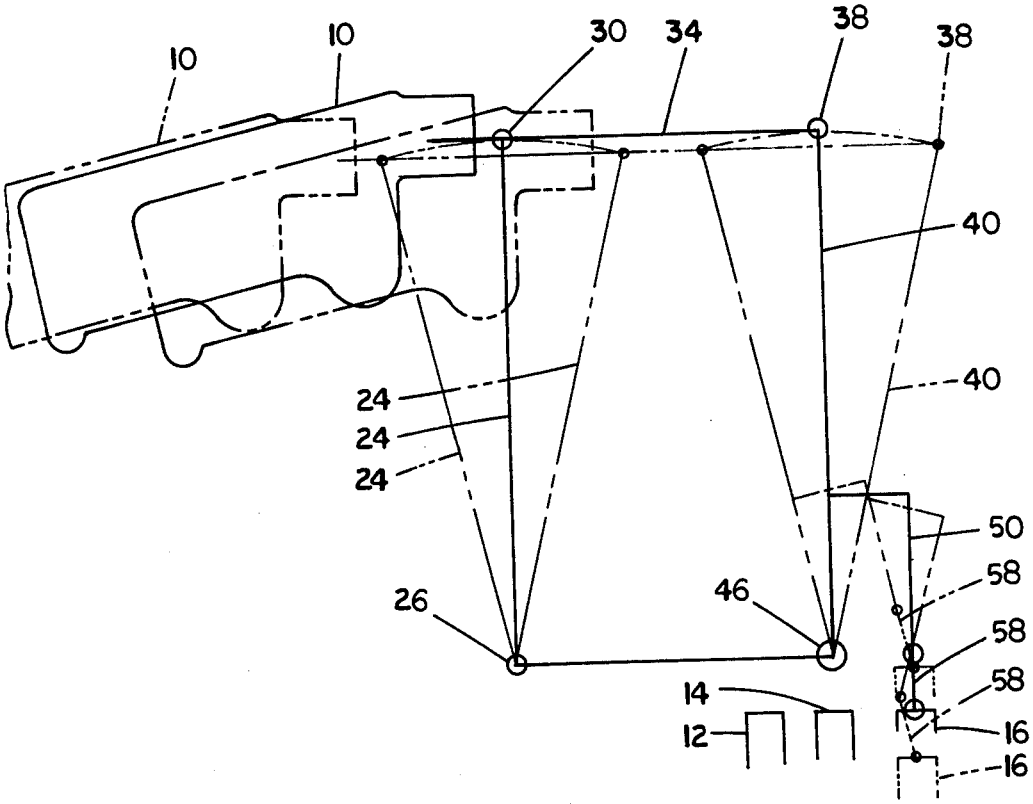
FIG. 6 illustrates schematically a second mode of operating the linkage to effect hydraulic actuation by a second one of the three spool valves, this particular mode of movement being obtained by horizontally back and forth movements of the handle.
Figure 7:
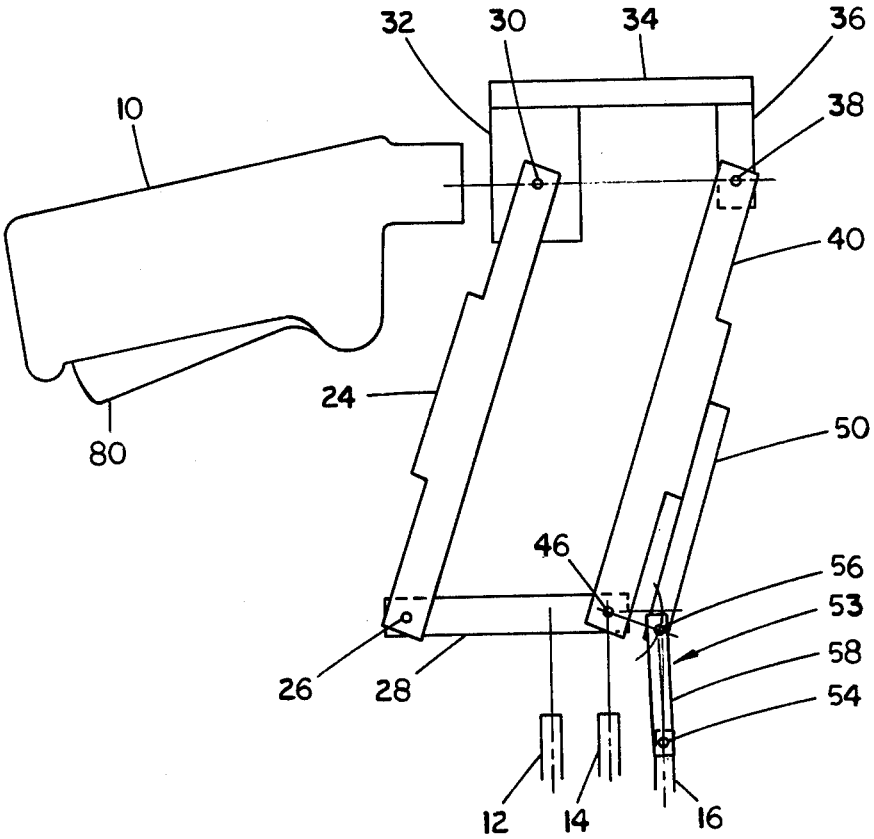
Figure 8:
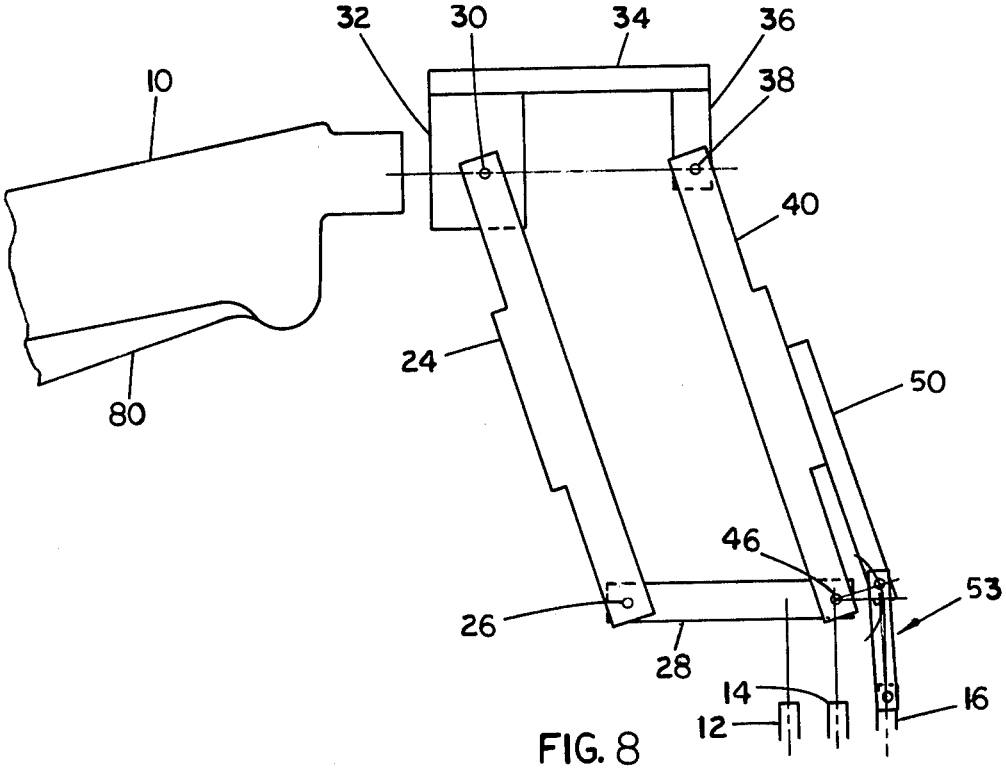

FIGS. 7, 8 illustrate schematically how the second spool valve is actuated by movement of the handle in a horizontal sense and thereby actuating the linkage to produce movement of the second spool valve and hence actuation of another portion of the hydraulic system. In FIGS. 5–8 the linkage bars are represented schematically by lines; and, FIG. 9 illustrates how the handle can be twisted on a horizontal axis to actuate a third one of the spool valves and thereby separately and distinctly control a further part of the hydraulic system associated with the third one of the spool valves.

DETAILED DESCRIPTION OF THE INVENTION

The invention is intended to be used in conjunction with the co-pending Application Ser. No. 720,569, "IMPROVED FLUID CONTROL SYSTEM" having the same inventor as the present application and assigned to the same assignee.

In the present invention, positioning of the basket or platform at the end of an articulated boom is determined by a control handle designated generally by reference numeral 10. The handle 10 is intended to operate in such a manner that it will position independently and separately any one of three position responsive spool valves 12, 14, and 16 which are received within a valve housing 18. Each spool valve controls a set of ports, and fluid under pressure is supplied by a power source (not shown) to valve housing 18 so that movement of one or the other of the spool valves 12–16 will communicate fluid under pressure to a power cylinder associated with movement of either the upper boom, the lower boom, or the turntable respectively whereby the platform at the end of the articulated boom can be selectively located.

It is an important aspect of the present invention that the handle 10 can separately and independently displace any one, or a combination of any one, of the spool valves 12, 14, or 16, thus obtaining the character and degree of movement of the platform desired.

Between handle 10 and the respective piston spool valves 12, 14, and 16 is an actuator linkage designated generally by reference numeral 20. Linkage 20 consists of link 24 pivotally secured at 26 to horizontal bar linkage 28 and is secured by pivot connection 30 to a bearing block 32. The bearing block 32 is in turn secured to horizontal link 34 and a yoke 36 having pivotal connections 38 with vertical link 40 pivotally secured at 46 to a mounting bracket 48.

There is secured to vertical link 40 at 52 a second vertical link 50 having a wrist pin connection 53 with spool valve 16 the wrist pin connection 53 consisting of a compound pivot 54, 56 and intermediate link 58 operatively interconnecting the vertical link 50 with valve 16.

Between valve 14 and the handle 10 is a connection consisting of a rod 60 having a ball connection 62 with an eccentric 64 (FIG. 3) operatively carried by a rotatable shaft 66 (FIG. 2) which is journaled for rotational movement within bore 33 of bearing block 32. By rotating the handle 10 it is possible to raise and lower the rod 60 and at end 70 of the rod another ball joint connection 72 which serves to communicate raising and lowering movement of the rod 60 to the valve 14. The raising and lowering movement of the rod 60 is obtained by the rotational movements of the lever 10, the rotational movement of the lever being translated to vertical movements of the rod 60 by means of the eccentricity of the ball connection 62 relative to the axis of rotation of shaft 66. Rod 60 can swivel at its opposite ends on the ball sockets 62,72 to accommodate for movement of the handle 10 to the right and to the left in FIGS. 7, 8 and without displacing either the valves 12 or 14.

Operation by the handle 10 of any one of the valves 12, 14 or 16 is ineffective unless trigger 80 which is pivotally supported at 82 (FIG. 2) in the handle 10 is rotated upwardly within the handle 10 by the operator gripping thereon. When the trigger 80 is gripped and retracted fully within the handle 10 it is rotated about 82 so that rod 84 slidably supported within an opening 86 of bearing 66 displaces the piston 90 within chamber 92 communicating pneumatic pressure through outlet port 94 to that part of the hydraulic system associated with the power cylinders adapted to effect actuation of the upper boom, lower boom, and turntable (not shown). The purpose of pneumatic pressure communicated from the outlet 94 is to either enable or prevent operation of those power cylinders associated with actuation of valves 12, 14 or 16 and unless the trigger 80 is fully drawn into the handle 10 by the operator's grip the operation of the power cylinders by the spool valves 12, 14, 16 is effectively prevented. The effect of the trigger, then, is to null or void the operation of the handle insofar as valves 12, 14 or 16 are concerned. Thus, if the operator should become incapacitated and not able to depress the trigger then the trigger acts as a "dead man" switch and prevents any operation whatsoever at the basket level. In that event controls at ground level which are separate and independent of the controls in the basket are effective for controlling the power cylinders associated with the booms and turntable and the basket can be lowered at will from ground level controls.

Figure 5:
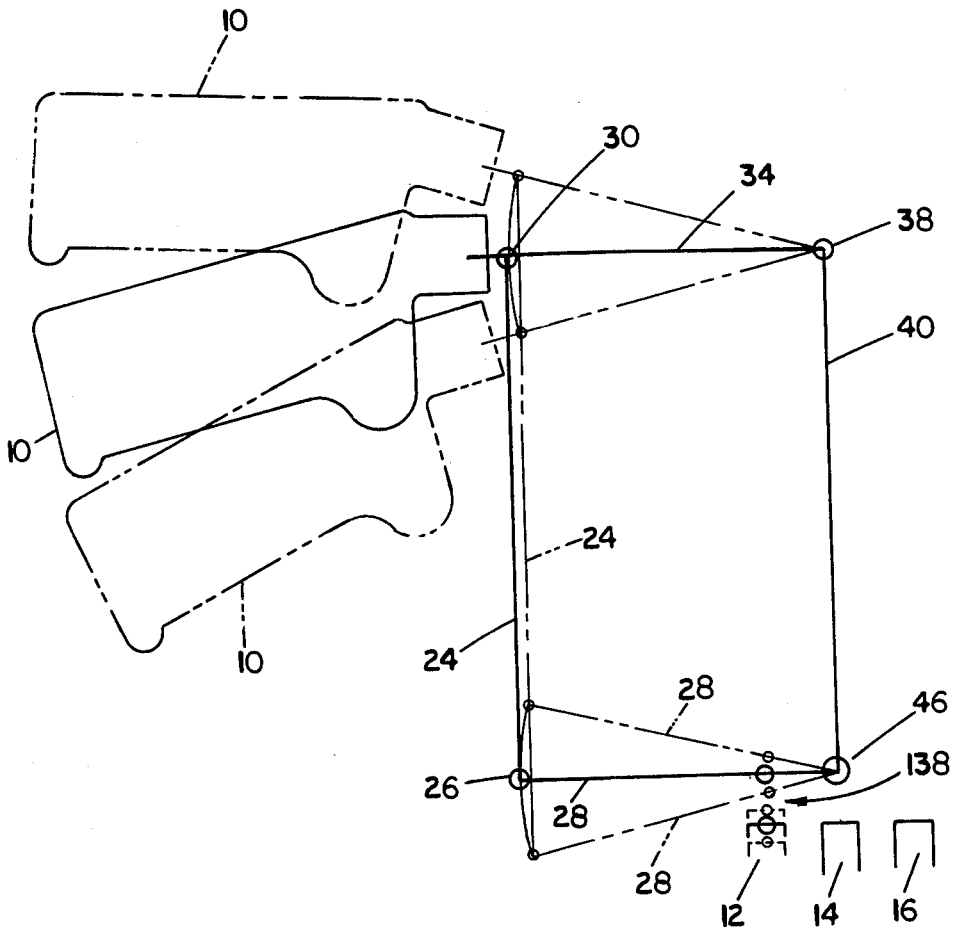
FIG. 5 illustrates schematically one mode of operating the linkage to effect hydraulic actuation by one of the three spool valves, this particular mode being a pivotal movement of the handle in a vertical plane.

The interior of the apparatus is protected by a rubber boot 100 which is fastened to a flange 102 of the valve casing and to flange 104 at the lower end to completely envelop the interior containing the operating linkage, but without in any way impeding movement of the lever 10 either horizontally as shown in FIGS. 7, 8, pivotally as shown in FIG. 5, or by rotating the handle on an axis coincident to longitudinal axis of shaft 66 (FIGS. 3, 9) which is journaled on bearing 112.

The assembly as a whole is mounted on a platform 130 and bracket 132 having mounting bolts and openings 134.

OPERATION

In operation, when it is desired to energize the lift cylinder associated with the upper boom and thereby effect vertically upward or downward movement, the handle 10 (FIGS. 1,2,5) is pivoted upwardly about pivot 38 (FIG. 5) to raise the basket and is pivoted downwardly about pivot 38 to lower the basket. As the handle 10 is pivoted upwardly (FIG. 1) about pivot 38, there is carried with it the shaft 66, cylinder block 32 and horizontal link 34 which is connected to a U-shaped link 36 pivotally connected at 38 to the vertical linkage bar 40. As the handle 10 is raised or lowered, the combined links 24, 34 and 36 are pivoted about pivot 38 at the end of link 40. Link 40 remains stationary. As link 24, however, is raised or lowered, the pivot connection 26 between link 24 and link 28 causes the link 28 to rotate about pivot connection 46.

Figure 1:
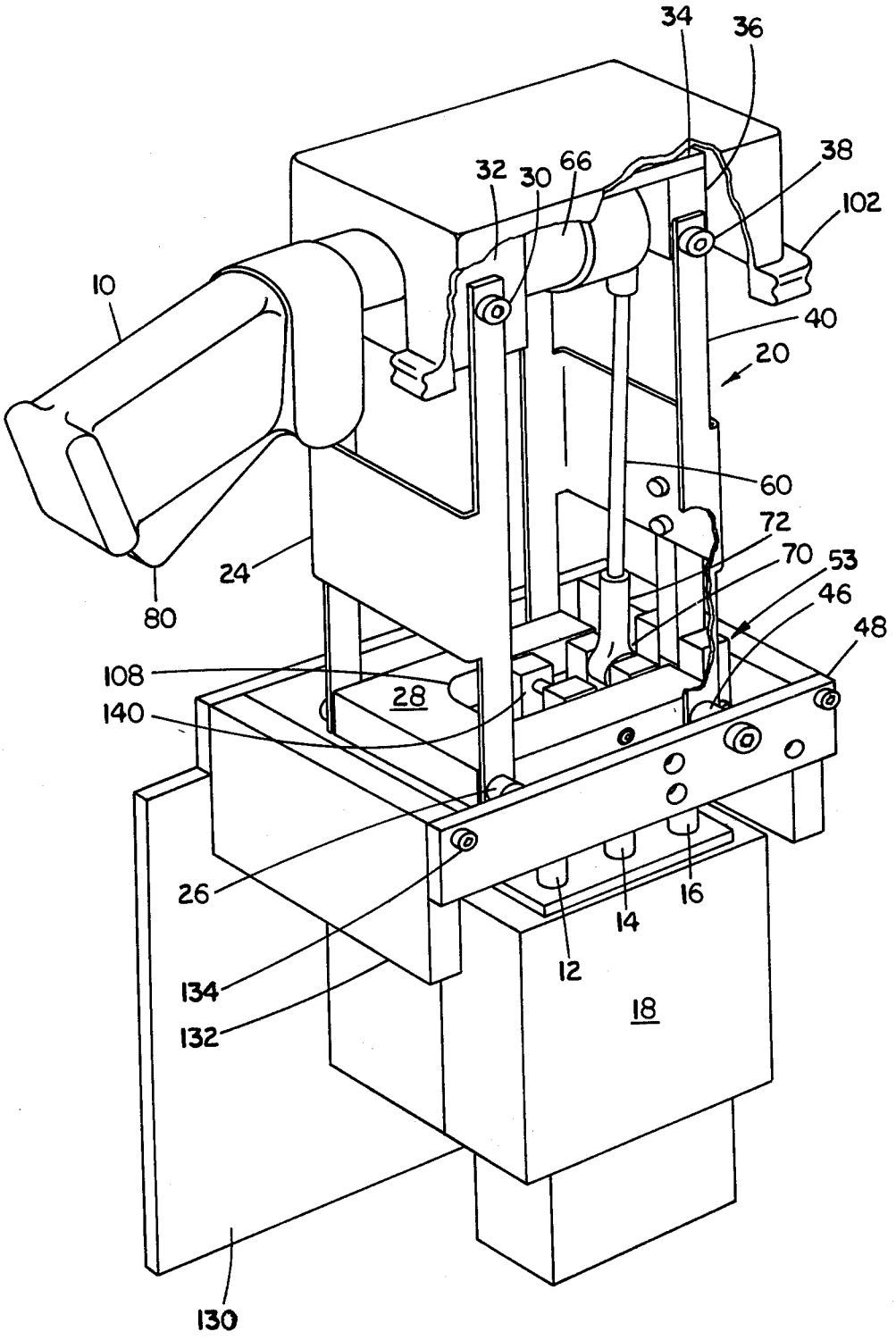
FIG. 1 is an isometric view of the control handle and associated linkage.
Figure 2:
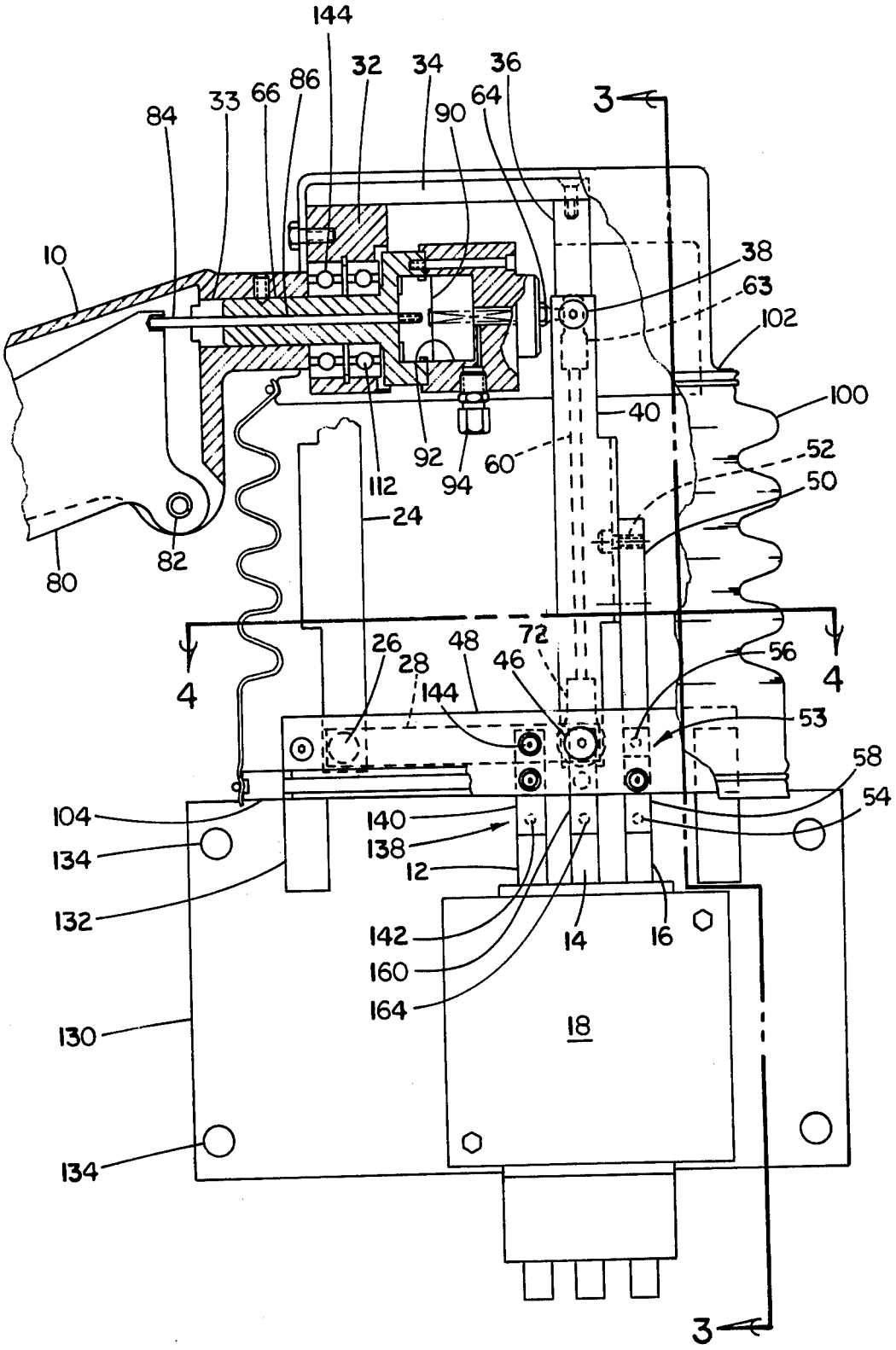
FIG. 2 is a side elevation view of structure shown in FIG. 1 with a portion of the casing for the actuator broken away to illustrate a part of the hydraulic system associated with the trigger for making the actuator system effective only upon depressing the trigger associated with the handle.

Comparing FIGS. 1,2 and 5, link 28 is constituted by a rectangular member having a notch 108 therein, mounted on the bracket 130 through pivot connections 46 and is caused to rotate or pivot in opposite directions by link 24 through the articulated connection between links 24 and 28. Within the notch 108 is a wrist pin connection 138 with valve 12. The wrist pin connection 138 consists of very small links 140 having articulated connections 142 and 144 with valve 12 and link 28 respectively in order that the pivotal movement of link 28 can be translated into reciprocable or vertical displacement of the valve 12. When the valve 12 is lowered, suitable fluid connections are made between a fluid pressure source and power cylinder (not shown) associated with the upper boom so that as long as the trigger 80 is gripped sufficiently to "arm" the hydraulic control system, and the handle 10 is raised (FIG. 1) in the manner shown in FIG. 5, the valve 12 will be raised and will continue to maintain fluid connections through the ports in the valve housing 18 to maintain raising movement of the basket. Conversely, when the handle 10 is counteracted about 38, the valve 12 is lowered and the basket is also lowered.

When it is desired to move the basket horizontally, handle 10 (FIG. 1) is pushed in a horizontal direction (FIGS. 7, 8) either to the right or to the left. Assuming that the handle 10 is pushed forwardly, this will cause the basket to move in the direction of the thrust of the handle. Similarly, if the handle is reversed, the basket will go in the opposite horizontal direction or in the direction corresponding to the handle movement. When the handle 10 (FIG. 7) is pushed forwardly, the basket will move in the same horizontal direction this being effected by the depression or downward movement of the valve 16. As the handle 10 is moved forwardly, links 24 and 40 are caused to rotate about 26 and 46 (FIG. 7) and link 50 which is operatively secured to link 40, is likewise caused to pivot about 46. As shown in FIG. 7, the pivotal movement of link 50 about 46 effects, through its articulated connection 54, 56, and 58, with valve 16 a downward movement of the valve 16 and thus establishes the necessary fluid power connection associated with the lower boom to cause the lower boom to pivot in a direction effecting substantially horizontal movement of the basket in the direction of handle displacement. When the handle 10 (FIGS. 6, 7, 8) is moved to the right the basket will move to the right; similarly, when the handle 10 is displaced to the left the basket will also be displaced to the left.

When it is desired to move the basket laterally, the valve 14 is operated establishing fluid pressure connections with the motor associated with the turntable so that both booms, and thus the basket, are rotated by the turntable, the turntable being mounted for movement about a vertical axis. In this case, such movement is effected by twisting the handle in a manner causing the rotation of shaft 66 on bearings 112, 114 (FIG. 2). This rotational movement is best seen from FIGS. 1, 3 and is shown schematically in FIG. 9. In this case, the shaft 66 journaled on the bearings, has an eccentrically mounted pin 64 with a ball 62 received within a companion ball socket 63 located at the end of rod 60. Rod 60 has a ball and ball socket connection 72 at end 70 and a stiff straight connection with valve 14 at connection 164 constituted by a bar 160 and articulated by ball and socket connections 70, 72, to valve 14. Thus, when the handle 10 is twisted in one direction, rotating the shaft 66 in one direction, the valve 14 is raised and counter-rotation or twisting of the handle 10 produces lowering of the valve 14. In either event, fluid connections are made through the valve body 18 and in ports associated with valve 14 to cause rotation of the booms on the turntable in one or the other direction as determined by the direction of twisting of the handle 10. As long as the handle remains twisted, the turntable movement continues, thus moving the booms and the basket in an arc about a vertical axis taken through the center of the turntable on the truck or vehicle which carries the movable platform.

Figure 3:
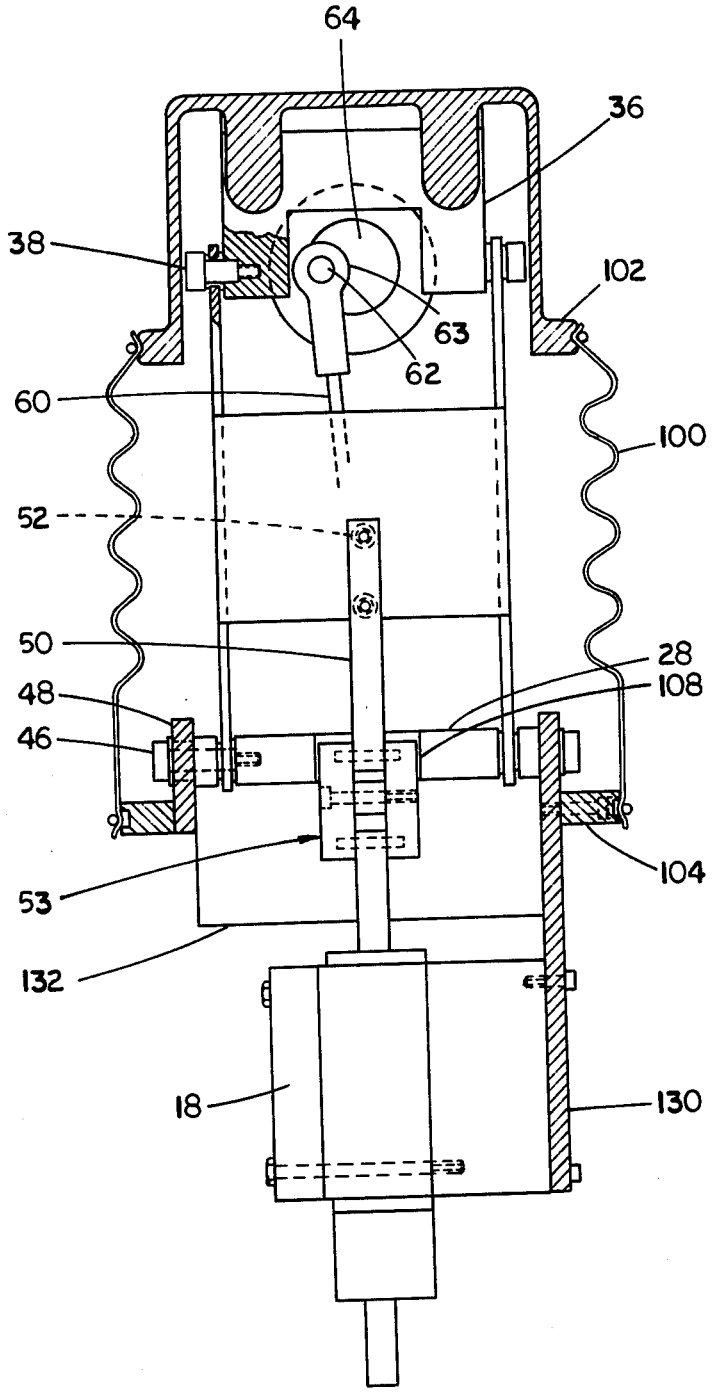
FIG. 3 is an end view looking in the directions of the arrows 4—4 in FIG. 2.
Figure 4:
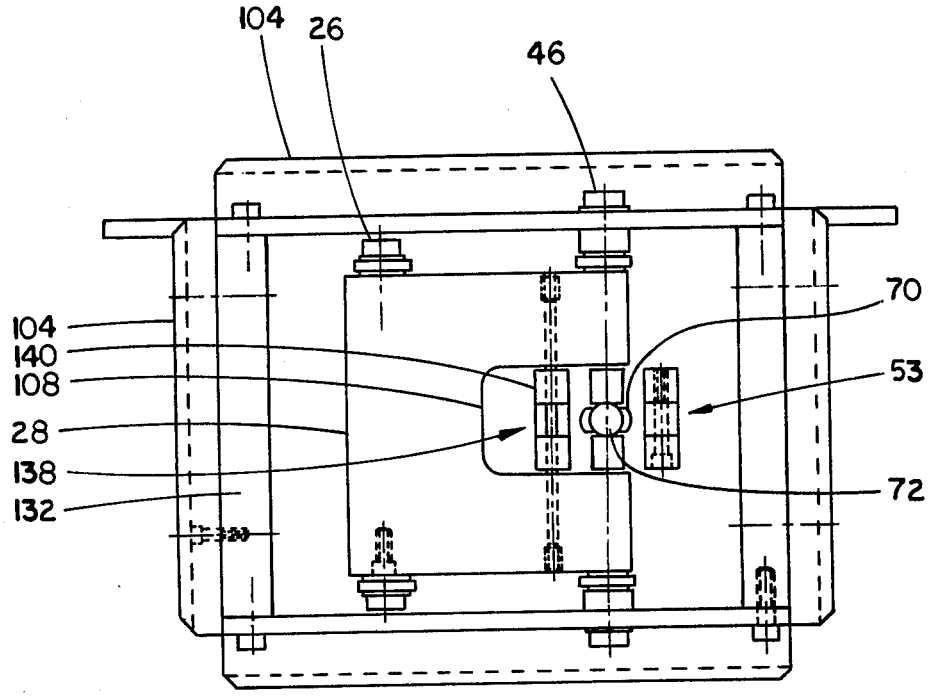
FIG. 4 is a section view looking in the direction of the arrows 4—4 in FIG. 2.

Each of the described handle movements, the pivoting as shown in FIG. 5, the horizontal movement as shown in FIGS. 6, 7, 8, or twisting movement indicated in FIGS. 3 and 9, are adapted to displace independently and separately valves 12, 14 and 16. It is also possible to produce a composite movement of the valves by concurrent movement of the handle in a combination of horizontal, pivotal and twisting movements so that the basket will follow whatever path is most efficient and expeditious in locating the occupant of the basket at the preferred location.

It should be understood that at no time are any of the valves 12, 14 or 16 effective to position the basket unless the trigger 80 has been gripped to such an extent as to cause rotation about 82 and its full retraction within handle 10 thereby displacing and maintaining displacement of the piston 90 within cylinder chamber 92. If the spring loaded trigger 80 should ever be counter-rotated to the position shown in FIG. 2 by relaxing the grip, further operation of the basket will be prevented regardless of the position or other movement of the handle 10 thereafter. This is a safety precaution which means that unless the operator is sufficiently conscious and capable of keeping the trigger depressed the basket will not operate responsively to any actuation which the operator may inadvertently or advertently desire by means of the handle 10 operation.

Although the present invention has been illustrated and described in connection with a few selected example embodiments it will be understood that these are illustrative of the invention and are by no means restrictive thereof. It is reasonably to be expected that those skilled in this art can make numerous revisions and adaptations of the invention and it is intended that such revisions and adaptations will be included within the scope of the following claims.

What is claimed is:

1. A control for regulating the duration and character of connections in a hydraulic system effecting three dimensional movement, comprising: an actuator connected to an actuator linkage having three articulated output connections, a reciprocal valve means one associated with each of the three articulated output connections of said actuator linkage and adapted for individual operation each independently of the others; said actuator linkage comprising a first parallelogram linkage displaceable by said actuator and movable in a vertical plane to effect actuation of one of the independent valve means by displacement movement thereon and a second parallelogram linkage pivotally movable by horizontal displacement of said actuator to effect independent movement of a second one of said valve means and, means responsive to rotation of said handle to effect a third independent valve means movement, whereby said valves are individually, independently and coordinately actuated in accordance with movements of said actuator.

2. The control in accordance with claim 1, including trigger means having pneumatic connections rendering movement of the actuator in respect to said three valve means operative or inoperative in accordance with whether the trigger is depressed.

3. The control in accordance with claim 1, said reciprocal valve means including a valve body having first, second and third spools and having hydraulic fluid connections.

4. The control in accordance with claim 3 in which hydraulic pressure is communicated continuously to said valve body.

5. A process for effecting operation of three spool valves comprising the steps of displacing a control in one of vertically upward and vertically downward directions to displace through a parallelogram linkage a first spool valve having a constant flow of hydraulic pressure to the valve body wherein said spool valve is received, displacing said control in a horizontal sense in one of opposite directions to effect through a parallelogram linkage the separate and distinct displacement of a second spool valve within said valve body; and twisting said control to effect through said same linkage a separate, independent and distinct movement of a third spool valve.

6. The process in accordance with claim 5 including the step of supplying to a valve body and to three valve cavities thereof continuous hydraulic fluid under pressure, wherein movement of said various valves by said control communicates through outlet means continuous hydraulic pressure when one or a combination of said valve means is diplaced.

* * * * *